US007963516B2

(12) United States Patent
Bokelman et al.

(10) Patent No.: US 7,963,516 B2
(45) Date of Patent: Jun. 21, 2011

(54) ACTUATION OF OUTPUT TRAY

(75) Inventors: Kevin Bokelman, San Diego, CA (US); Ryan M. Smith, San Diego, CA (US); Gustaf L. Belt, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 131 days.

(21) Appl. No.: 12/252,040

(22) Filed: Oct. 15, 2008

(65) Prior Publication Data

US 2009/0278302 A1 Nov. 12, 2009

Related U.S. Application Data

(60) Provisional application No. 61/050,747, filed on May 6, 2008.

(51) Int. Cl.
*B65H 5/22* (2006.01)

(52) U.S. Cl. ..... 271/3.14; 271/207; 271/213

(58) Field of Classification Search ..... 271/3.14, 271/145, 162, 207, 213; 347/104; 399/393, 399/405

See application file for complete search history.

(56) References Cited

U.S. PATENT DOCUMENTS

| | | | | |
|---|---|---|---|---|
| 4,869,488 | A | 9/1989 | Hirota et al. | |
| 5,897,113 | A * | 4/1999 | Kondo et al. | 271/213 |
| 6,923,584 | B2 | 8/2005 | Namekawa et al. | |
| 7,243,915 | B2 * | 7/2007 | Wong et al. | 271/3.14 |
| 7,261,290 | B2 | 8/2007 | Funk et al. | |
| 7,300,052 | B2 | 11/2007 | Tamura et al. | |
| 2005/0179757 | A1 * | 8/2005 | Namekawa et al. | 347/86 |
| 2005/0244204 | A1 * | 11/2005 | Seo et al. | 399/405 |
| 2005/0280684 | A1 * | 12/2005 | Kawakami et al. | 347/104 |
| 2008/0048387 | A1 * | 2/2008 | Matsumoto | 271/207 |

OTHER PUBLICATIONS

Cannon Packs Photo Quality with Fast Print and Copy Speeds in its New Entry-Level MuItiPASS MP370 and MP360; Canon News; Oct. 27, 2003; 4 pages; http://www.canon.ca/press.

Canon Pixma MP760 Photo All-In-One announced; PMA Spring 2005 Show; Feb. 17, 2008; http://www.imaging-resource.com/events/pmas05/1108645802.html.

* cited by examiner

*Primary Examiner* — Jeremy Severson

(57) ABSTRACT

A media reproduction device has an input tray and an output tray. Commencement of a print job causes the output tray to move from a closed position to an open position. A gear attaches to the output tray, the gear being engaged with a pick transmission to move the output tray to the open position and being disengaged from the pick transmission so the output tray freely rotates while in the open position.

17 Claims, 4 Drawing Sheets

ACTUATION OF OUTPUT TRAY

CROSS REFERENCE TO RELATED APPLICATIONS

This Application claims the benefit of provisional patent application Ser. No. 61/050,747, filed May 6, 2008; entitled "Actuation Of Output Tray" which application is incorporated by reference herein as if reproduced in full below.

BACKGROUND

Media reproduction devices, such as printers and copiers, include both an input tray and an output tray. The location of these trays plays an important role in the size, cost, and user experience of the device. As an example, if the trays are not provided in a good location, the overall size of the device can be large and more expensive to package and transport. As another example, if these two trays are not readily distinguishable, then a user can mistakenly place media, such as photo paper, into the wrong tray and jam the device. Furthermore, users can load additional media into the input tray while the device is still printing. Loading media while a job is printing (also known as "hot loading") can result in too many sheets in the output tray and finally paper crashing.

DETAILED DESCRIPTION

Exemplary embodiments are directed to apparatus, systems, and methods for automatically actuating an output tray of a media reproduction device to an open position upon commencement of a media operation or print job.

In one embodiment, the media reproduction device has an input tray and an output tray. These two trays are located adjacent each other on a body of the media reproduction device. When a print job is received, the output tray automatically opens or moves from a closed position to an open position. Movement of the output tray to the open position occurs before media is reproduced and copies ejected to the output tray and occurs without user assistance (i.e., occurs without the user physically moving the tray, for example, with a hand).

By having the media output tray open automatically upon the commencement of a print job, numerous results are achieved.

As a first result, the overall size of the media reproduction device is smaller and less expensive to package and transport. The media reproduction device is shipped or packaged with the output tray in the closed position which reduces the shipping size of the device. In one embodiment, the output tray folds up to a closed position.

As a second result, no confusion exists about into which tray a user should insert a stack of media. Before a print job begins, the output the tray is in the closed position and covered up or partially concealed. In this closed position, a user cannot accidentally place media into the output tray since access to this tray is concealed with an underside of the output tray itself.

As a third result, it is much more difficult to "hot load" the media reproduction device after a print job has started because the input tray is partially or fully occluded or obstructed by the output tray. When the output tray is in an open position, a portion of the output tray extends over or covers the input tray. The overall size of or access to the input tray is reduced while the output tray is open. Reduction in size of the input tray is sufficient to prevent a hand of a user from fitting underneath the output tray to add more media to the input tray. Thus, users cannot readily load additional media into the input tray while the media reproduction device is still printing.

Figure 1A:
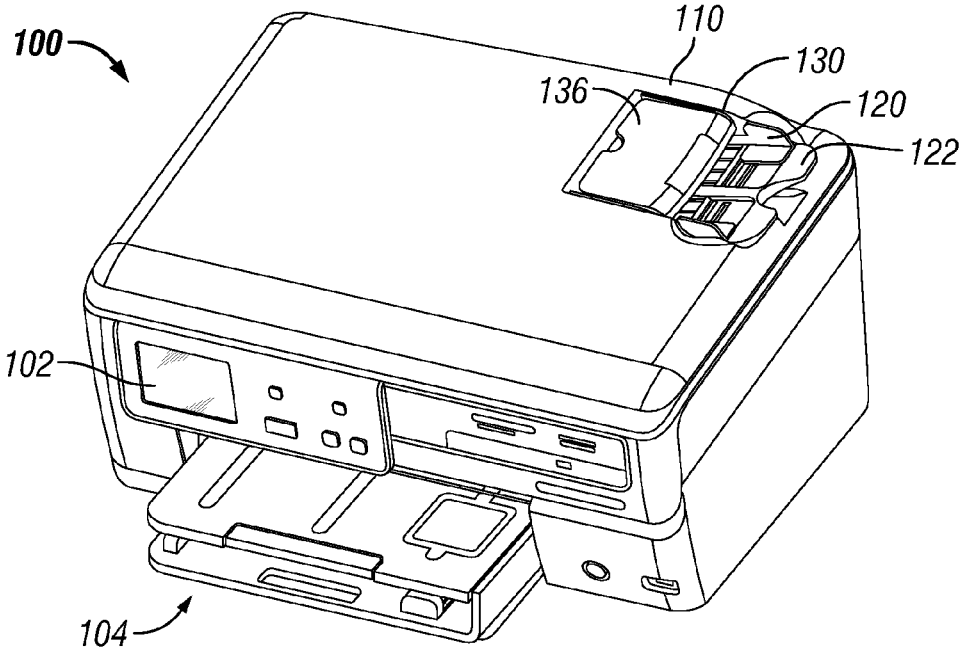
FIG. 1A is a media reproduction device with a media output tray in a closed position in accordance with an exemplary embodiment.
Figure 2A:
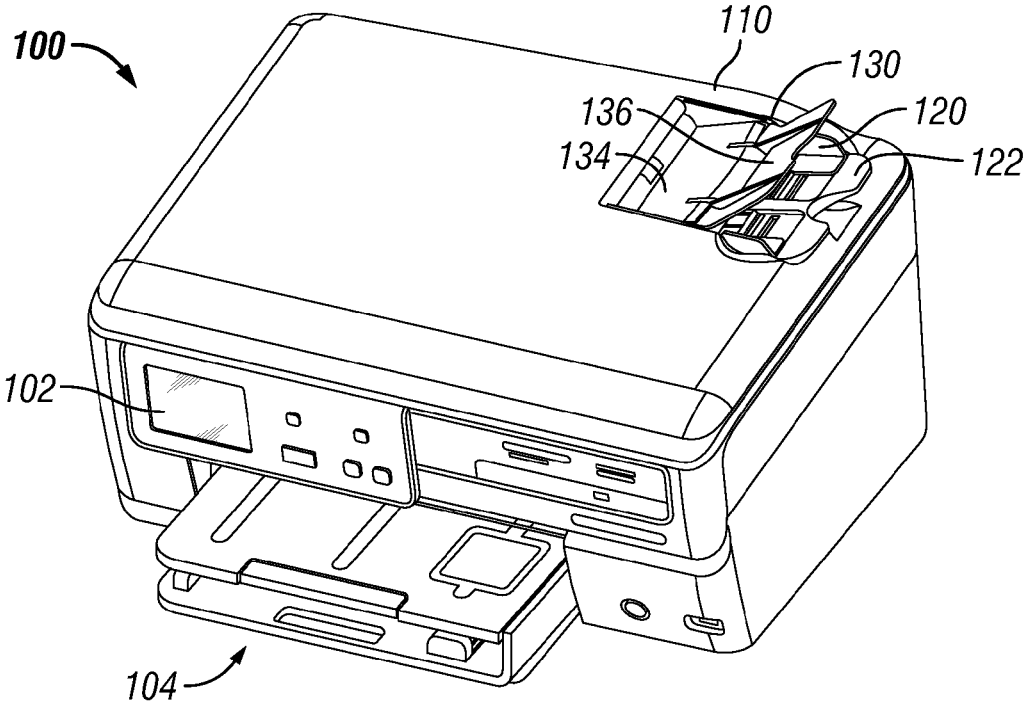
FIG. 2A is the media reproduction device with the media output tray in an open position in accordance with an exemplary embodiment.

Exemplary embodiments are utilized in a wide variety of electronic media reproduction devices. By way of example, FIGS. 1A and 2A show an exemplary media reproduction device 100 that performs one or more of printing, copying, scanning, and sending/receiving facsimiles, to name a few examples. In one embodiment, the device is a multi-functional device (MFD) that incorporates the functionality of a computer and/or one or more peripheral devices, such as a printer, copier, scanner, facsimile machine, telephone, etc.

Device 100 includes a display or interface 102 and one or more media trays, such as paper tray 104 and photo tray 110. For illustration, exemplary embodiments are described in connection with the photo tray 110, but exemplary embodiments are not limited to any particular type of media or media tray.

The photo tray 110 includes an input tray 120 and an output tray 130. Media is placed, stacked, or loaded onto a platform or surface 122 of the input tray 120. During copying or printing, media moves into the media reproduction device 100 and then is ejected out to the output tray 130.

Figure 1B:
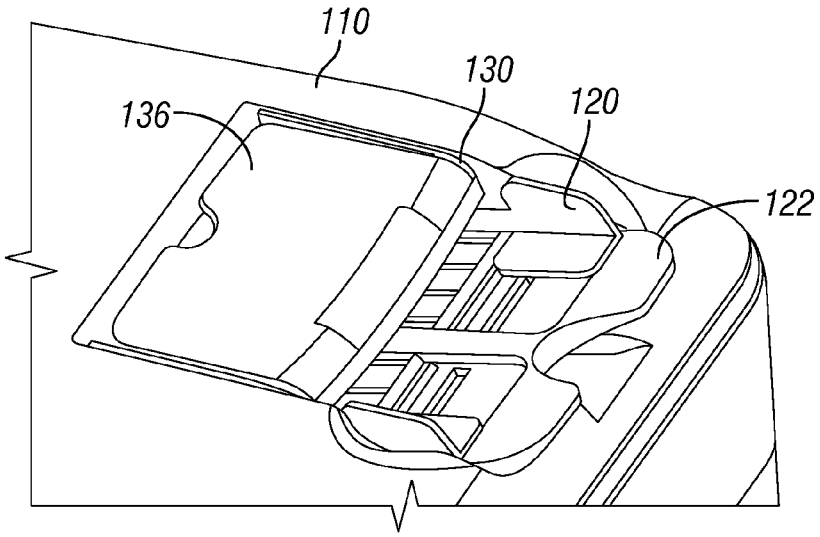
FIG. 1B is an enlarged view of the media output tray of FIG. 1A in accordance with an exemplary embodiment.
Figure 2B:
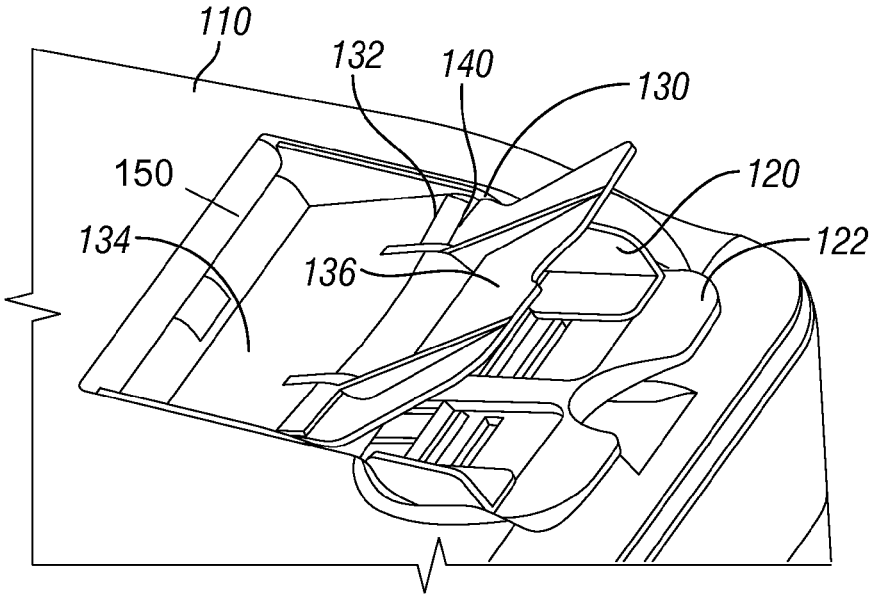
FIG. 2B is an enlarged view of the media output tray of FIG. 2A in accordance with an exemplary embodiment.

As best shown in FIGS. 2A and 2B, the output tray 130 includes a body 132 with two parts: a stationary member or portion 134 and a movable member or portion 136. A hinge 140 connects the movable member 136 to the stationary member 134. As such, the movable member 136 can move, rotate, or flip from a closed position (FIG. 1B) to an open position (FIG. 2B).

FIGS. 1A and 1B show the output tray 130 in a closed position. In this position, the stationary member 134 (FIG. 2A) and movable member 136 are adjacent and parallel with each other such that the movable member sits on top of the stationary member. In this closed position, an opening or exit 150 (shown best in FIG. 2B) is blocked. Thus, media cannot be ejected from the exit or output from the output tray while it is in the closed position. A user is thus precluded from mistakenly placing or positioning media into the output tray 130 for loading. Since only the input tray 120 is accessible, a user will more likely accurately place media to be copied into the input tray 120 instead of misplacing the media into the output tray 130.

FIGS. 2A and 2B show the output tray 130 in an open position. In this position, the stationary member 134 and movable member 136 are separated such that the movable member forms an extension of the stationary member. In this open position, the exit 150 is unrestricted (i.e., not blocked) so printed media can freely exit or eject after being copied or printed.

When the output tray 130 is in the open position, the input tray 120 is at least partially occluded with the body 132 of the output tray. As best shown in FIG. 2B, the movable member 136 extends above or into an area occupied by the input tray 120. The body of the output tray thus prevents or restricts a hand of a user from adding more media into the input tray. This prevents a user from adding media into the input tray while a print job is executing.

Figure 3:
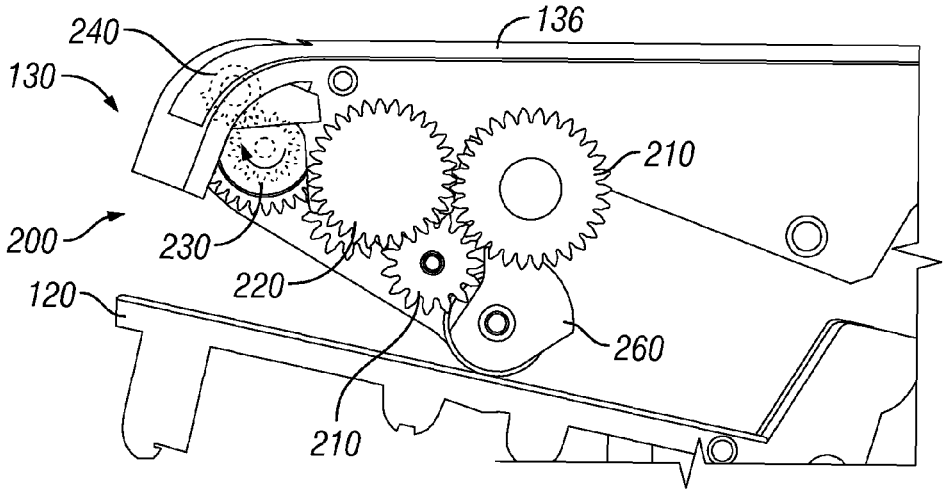
FIG. 3 is an enlarged view of gearing for the media output tray that is in a closed position in accordance with an exemplary embodiment.
Figure 4:
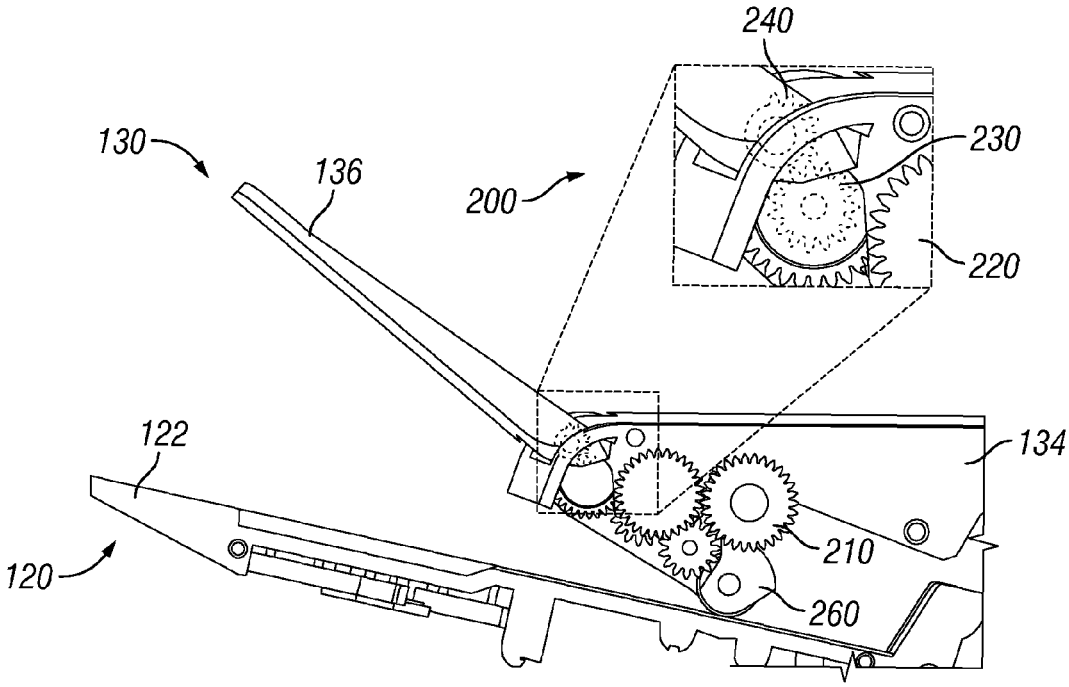
FIG. 4 is an enlarged view of the gearing for the media output tray that is in an open position in accordance with an exemplary embodiment.

FIGS. 3 and 4 show an enlarged view of the pick transmission or gearing 200 for the media output tray that is in a closed position (FIG. 3) and an open position (FIG. 4) in accordance with an exemplary embodiment.

The gearing 200 includes one or more drive gears 210 coupled to a transfer gear 220 which is coupled to a pinion gear 230 and an output tray gear 240. These gears are driven by a motor to perform pick operations during a print job and move the output tray 130. A roller or picker 260 is positioned against the surface 122 of the input tray 120 in order to grab or pick media and transport it into the media reproduction device for printing or copying.

The output tray gear 240 is attached to the output tray 130, and the pinion gear 230 is meshed to the output tray gear 240. When the media reproduction device begins a pick operation of media from the input tray 120, a motor and the pick transmission rotate the pinion gear 230 in a clockwise direction. As the pinion gear 230 rotates in a clockwise direction, it causes the output tray gear 240 to rotate in a counterclockwise direction. Movement of the output tray gear 240 causes the movable member 136 of the output tray 130 to move or rotate to the open position.

When the output tray 130 is in the closed position (FIG. 3), the teeth of the output tray gear 240 are meshed with the teeth of the pinion gear 230. When the output tray 130 is in the open position (FIG. 4), the teeth of the output tray gear 240 are no longer meshed or in contact with the teeth of the pinion gear 230. In other words, once the output tray moves to the open position, the teeth on the output tray gear 240 are no longer engaged with the pinion gear 230.

In one exemplary embodiment, the output tray 130 falls the last 10 degrees under its own weight to the fully opened position. Now the pick transmission and/or the pinion gear 230 can rotate in either direction without touching the output tray gear 240. When the user tries to close the output tray 130, the output tray gear 240 is not engaged so there is little resistance to close the output tray 130.

In one exemplary embodiment, the output tray 130 automatically moves from the closed position to the open position upon actuation of a print job. The output tray, however, remains in the open position until a user manually moves the movable member 136 back to the closed position.

One skilled in the art will appreciate that a variety of mechanism can be used to move the output tray from the closed to open position. The gearing 240 provides an example of such a mechanism.

Figure 5:
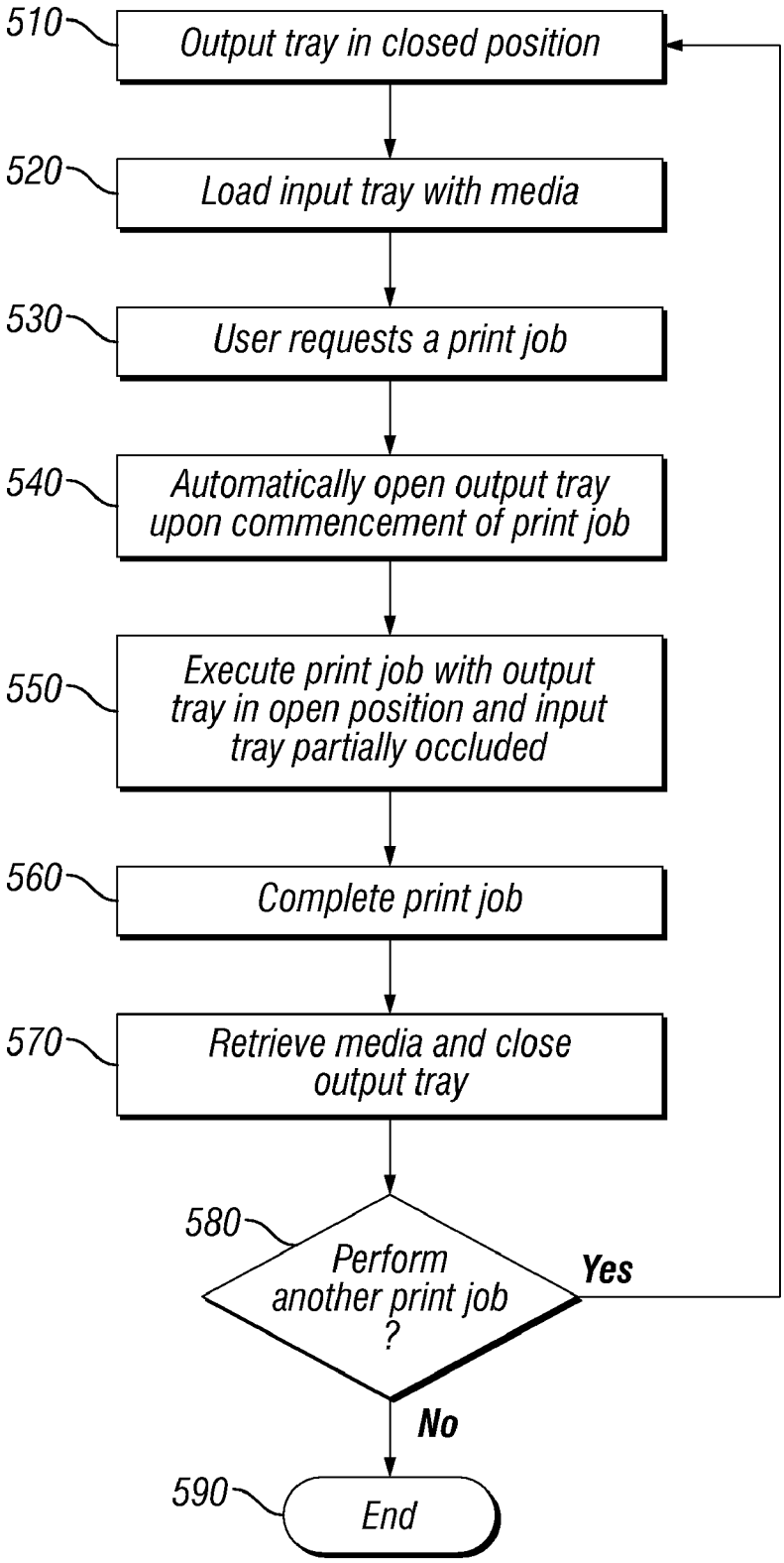
FIG. 5 is a flow diagram for automatically actuating the media output tray from a closed position to an open position upon commencement of a print job in accordance with an exemplary embodiment.

FIG. 5 is a flow diagram for automatically actuating the media output tray from a closed position to an open position upon commencement of a print job in accordance with an exemplary embodiment.

According to block 510, the output tray is initially in a closed position. In this position, a user cannot accidentally load media (such as photos or paper) into the output tray since access to this tray is blocked.

According to block 520, a user loads media into the input tray. For example, a user loads a stack or photos or paper into the input tray.

According to block 530, a user requests a print job. For example, a user actuates the media reproduction device to begin printing or copying. This actuation causes a print or copy instruction or command to instruct the media reproduction device to begin a print job.

According to block 540, the output tray automatically opens upon commencement of the print job. For example, the gear mechanism causes the output tray to move or rotate from the closed position to the open position. Actuation or movement of the output tray occurs before media is reproduced and sent to the output tray. This ensures that the output tray is properly positioned in the open position to receive media once copying or reproduction begins.

According to block 550, the print job begins to execute while the output tray is in the open position and the input tray is at least partially occluded. While the output tray is extended or moved to the open position, access to the input tray is prevented or at least limited. This prevents a user from hot loading media into the input tray while a print job is still executing.

According to block 560, the print job completes.

According to block 570, the printed or copied media is retrieved from the output tray.

According to block 580, a question is asked whether another print job will be performed. If the answer to this question is "yes" then flow proceeds back to block 510 and the output tray is moved to the closed position so a user can load additional media into the input tray. If the user does not desire to load additional media, then blocks 510 and 520 are skipped and the user commences the next print job according to block 530. On the other hand, if the answer to this question is "no" then flow proceeds to block 590 and the process ends.

As used herein and in the claims, the term "print operation" or "print job" means a process to copy or reproduce something.

In one exemplary embodiment, one or more blocks or steps discussed herein are automated. In other words, apparatus, systems, and methods occur automatically. As used herein and in the claims, the terms "automated" or "automatically" (and like variations thereof) mean controlled operation of an apparatus, system, and/or process using computers and/or mechanical/electrical devices without the necessity of human intervention, observation, effort and/or decision.

The methods in accordance with exemplary embodiments are provided as examples and should not be construed to limit other embodiments. For instance, blocks in diagrams or numbers (such as (1), (2), etc.) should not be construed as steps that must proceed in a particular order. Additional blocks/steps may be added, some blocks/steps removed, or the order of the blocks/steps altered and still be within the scope of the exemplary embodiments. Further, methods or steps discussed within different figures can be added to or exchanged with methods of steps in other figures. Further yet, specific numerical data values (such as specific quantities, numbers, categories, etc.) or other specific information should be interpreted as illustrative for discussing exemplary embodiments. Such specific information is not provided to limit embodiments.

Various embodiments are implemented as a method, system, and/or apparatus. As one example, exemplary embodiments and steps associated therewith are implemented as one or more computer software programs to implement the methods described herein (such as software stored in a memory of the media reproduction device). The software is implemented as one or more modules (also referred to as code subroutines, or "objects" in object-oriented programming). The location of the software will differ for the various alternative embodiments. The software programming code, for example, is accessed by a processor or processors of the computer or server from long-term storage media of some type, such as a CD-ROM drive or hard drive. The software programming code is embodied or stored on any of a variety of known media for use with a data processing system or in any memory device such as semiconductor, magnetic and optical devices, including a disk, hard drive, CD-ROM, ROM, etc. The code is distributed on such media, or is distributed to users from the memory or storage of one computer system over a network of some type to other computer systems for use by users of such other systems. Alternatively, the programming code is embodied in the memory and accessed by the processor using the bus. The techniques and methods for embodying software programming code in memory, on physical media, and/or distributing software code via networks are well known and will not be further discussed herein.

The above discussion is meant to be illustrative of the principles and various embodiments. Numerous variations and modifications will become apparent to those skilled in the art once the above disclosure is fully appreciated. It is intended that the following claims be interpreted to embrace all such variations and modifications.

What is claimed is:

1. A media reproduction device, comprising:

an input tray that receives media for a print job;

an output tray that moves without user assistance from a closed position to an open position when the print job commences, wherein the output tray obstructs access to the input tray when the output tray is in the open position; and a gear attached to the output tray, the gear being engaged with a pick transmission to move the output tray to the open position and being disengaged from the pick transmission so the output tray freely rotates while in the open position.

2. The media reproduction device of claim 1, wherein the output tray rotates about a hinge to move from the closed position to the open position.

3. The media reproduction device of claim 1, wherein the output tray is manually foldable from the open position to the closed position to reduce an overall size of the media reproduction device for shipping.

4. The media reproduction device of claim 1, wherein the output tray covers an exit for media in the closed position to prevent users from mistakenly placing media in the output tray before the print job.

5. The media reproduction device of claim 1, wherein the output tray includes a body with a stationary member and a movable member that rotates between the open position and the closed position.

6. The media reproduction device of claim 1, wherein a body of the output tray extends into a space occupied by the input tray to prevent the user from loading media into the input tray while the media reproduction device is executing the print job.

7. A method, comprising:

covering a stationary member of an output tray of a media reproduction device with a movable member of the output tray when the output tray is in a closed position; and automatically rotating with a motor the movable member off the stationary member so the movable member forms an extension with the stationary member and places the output tray in an open position upon commencing a print job, wherein the output tray precludes access to an input tray when the output tray is in the open position.

8. The method of claim 7 further comprising, rotating the movable member about a hinge to move the movable member off the stationary member and move the output tray from the closed position to the open position, wherein the hinge extends between the movable member and the stationary member.

9. The method of claim 7 further comprising, disengaging a gear connected to the output tray so the output tray can be manually moved from the open position to the closed position.

10. The method of claim 7 further comprising, preventing, with a body of the output tray, a user from loading media into the input tray while the media reproduction device is executing the print job.

11. The method of claim 7 further comprising, covering an exit for output of printed media with the output tray when the output tray is in the closed position to prevent a user from placing media in the output tray instead of the input tray.

12. An apparatus, comprising:

an input tray that receives media for a print job; and an output tray that holds the media after the print job executes, wherein commencement of the print job causes the apparatus to move the output tray from a closed position to an open position, the output tray has a body with a stationary member and a movable member, the movable member sitting on top of and covering the stationary member when the output tray is in the closed position, and the movable member forming an extension of the stationary member when the output tray is in the open position, wherein the output tray obstructs an exit for printed media while the output tray is in the closed position.

13. The apparatus of claim 12, wherein the output tray obstructs access to the input tray when the output tray is in the open position.

14. The apparatus of claim 12, wherein a hinge extends between the movable member and the stationary member, and the movable member rotates about the hinge to move from the closed position to the open position.

15. The apparatus of claim 12, wherein the output tray disengages from a gear when the output tray is positioned into the open position so a user can manually move the output tray back to the closed position.

16. The apparatus of claim 12, wherein the output tray moves into an area adjacent to the input tray to preclude a hand of a user from adding media while the print job executes.

17. The apparatus of claim 12, wherein the output tray folds upon itself in the closed position to reduce an overall size of the apparatus for shipping.

* * * * *